US012017744B2

(12) United States Patent
Festa

(10) Patent No.: US 12,017,744 B2
(45) Date of Patent: Jun. 25, 2024

(54) IN-PORT SHIP EXHAUST CAPTURE DEVICE

(71) Applicant: Greener Process Systems Inc., Boca Raton, FL (US)

(72) Inventor: Enrico Festa, Procida (IT)

(73) Assignee: Greener Process Systems Inc., Boca Raton, FL (US)

( * ) Notice: Subject to any disclaimer, the term of this patent is extended or adjusted under 35 U.S.C. 154(b) by 0 days.

(21) Appl. No.: 18/130,740

(22) Filed: Apr. 4, 2023

(65) Prior Publication Data

US 2023/0234692 A1 Jul. 27, 2023

Related U.S. Application Data

(63) Continuation of application No. 17/362,141, filed on Jun. 29, 2021, now Pat. No. 11,634,203.

(51) Int. Cl.

| | |
|---|---|
| ***B63H 21/32*** | (2006.01) |
| ***F01N 13/08*** | (2010.01) |
| ***F01N 13/18*** | (2010.01) |

(52) U.S. Cl.

CPC ..... *B63H 21/32* (2013.01); *F01N 13/08* (2013.01); *F01N 13/1805* (2013.01)

(58) Field of Classification Search

CPC ..... F01N 13/004; F01N 13/1838; F01N 2590/02; F01N 13/008; F01N 13/08; (Continued)

(56) References Cited

U.S. PATENT DOCUMENTS

| | | | |
|---|---|---|---|
| 6,158,213 | A | 12/2000 | Linberg et al. |
| 7,258,710 | B2 | 8/2007 | Caro et al. |

(Continued)

FOREIGN PATENT DOCUMENTS

| | | | |
|---|---|---|---|
| EP | 3112011 | A1 | 1/2017 |
| IT | 201900008235 | A1 | 12/2020 |
| JP | 2007-204023 | A | 8/2007 |

OTHER PUBLICATIONS

European Search Report issued in Appln. No. 22184185.1 mailed Mar. 7, 2023 (8 pages).

*Primary Examiner* — Anthony Ayala Delgado
(74) *Attorney, Agent, or Firm* — Lerner David LLP

(57) ABSTRACT

A device for capturing in-port ship exhaust gases is designed to be connected to a ship, when the ship has at least one funnel that serves as an outlet for exhaust gases. The device includes at least one collection device, including a hood designed to connect to the funnel at the exhaust outlet so as to collect the exhaust gases coming out of the funnel, a handling unit designed to move the collection device and position it at the exhaust outlet, a first constraint configured to interconnect or disconnect the collection device and the handling unit by command so as to create a handling configuration in which the collection device and the handling unit are interconnected by the first constraint and can be moved as one, and a collection configuration in which the collection device collects the exhaust gases and the connection achieved by the first constraint is released, and a second constraint configured to exert a magnetic attraction force, by command, intended to put the first constraint into the handling configuration.

18 Claims, 6 Drawing Sheets

(58) Field of Classification Search
CPC .. F01N 13/10; F01N 13/1805; F01N 2450/10; F01N 3/00; F01N 3/24; B63H 21/32; B63H 21/34
See application file for complete search history.

(56) References Cited

U.S. PATENT DOCUMENTS

| | | | | |
|---|---|---|---|---|
| 8,075,651 | B2 | 12/2011 | Caro et al. | |
| 8,402,746 | B2 | 3/2013 | Powell et al. | |
| 8,808,415 | B2 * | 8/2014 | Caro | B63H 21/32 440/89 R |
| 9,364,874 | B2 | 6/2016 | Morgan | |
| 10,132,220 | B2 | 11/2018 | Tonsich | |
| 10,287,940 | B2 | 5/2019 | Tonsich | |
| 10,422,260 | B2 | 9/2019 | Tonsich | |
| 10,619,539 | B2 | 4/2020 | Tonsich | |
| 10,900,399 | B2 | 1/2021 | Tonsich | |
| 10,970,927 | B2 | 4/2021 | Sharp | |
| 11,215,095 | B2 | 1/2022 | Tonsich | |
| 11,325,687 | B1 | 5/2022 | Sharp | |
| 11,480,089 | B1 * | 10/2022 | Festa | F01N 13/1838 |
| 11,634,203 | B2 * | 4/2023 | Festa | B63H 21/32 440/89 R |
| 11,635,012 | B1 * | 4/2023 | Festa | B63H 21/32 137/12 |
| 2005/0244318 | A1 * | 11/2005 | Caro | B01D 53/92 422/177 |
| 2007/0209544 | A1 * | 9/2007 | Caro | B61C 5/04 105/26.05 |
| 2009/0197489 | A1 | 8/2009 | Caro et al. | |
| 2010/0180559 | A1 * | 7/2010 | Caro | F23J 11/04 55/385.1 |
| 2011/0065113 | A1 | 3/2011 | Chinnaiyan et al. | |
| 2011/0083556 | A1 | 4/2011 | Duesel, Jr. et al. | |
| 2011/0265449 | A1 | 11/2011 | Powell et al. | |
| 2016/0023154 | A1 * | 1/2016 | Morgan | B65G 69/18 55/385.2 |
| 2017/0342883 | A1 | 11/2017 | Tonsich | |
| 2018/0306078 | A1 | 10/2018 | Tonsich | |
| 2019/0264596 | A1 | 8/2019 | Sharp | |
| 2020/0240302 | A1 | 7/2020 | Tonsich | |
| 2021/0172358 | A1 | 6/2021 | Tonsich | |
| 2023/0294014 | A1 | 9/2023 | Walker | |

* cited by examiner

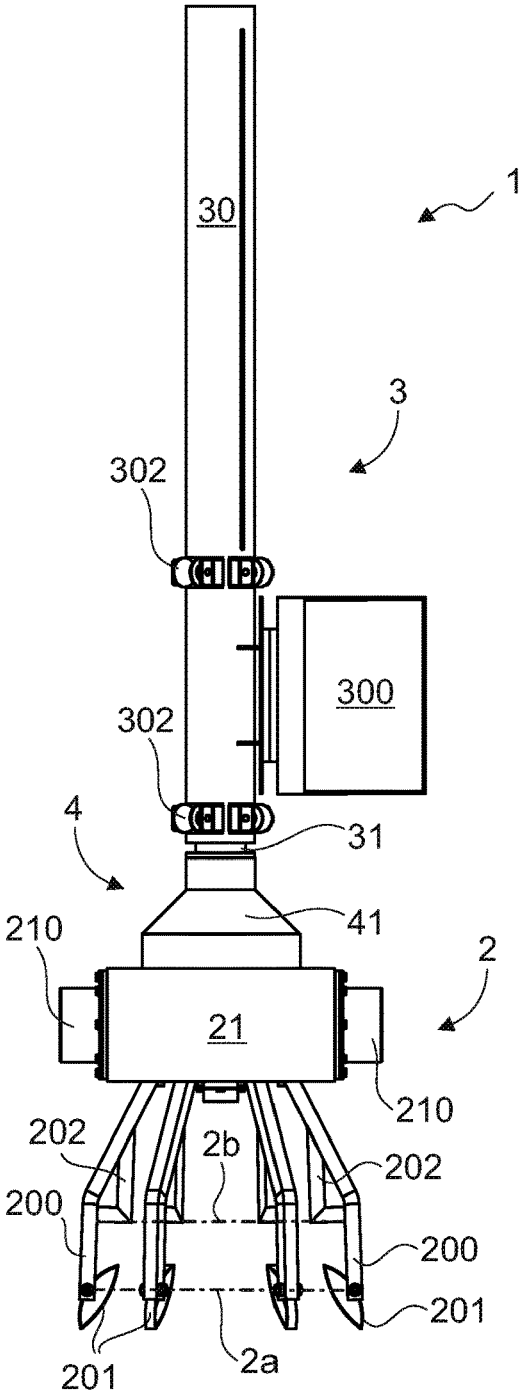
Fig. 2a
Fig. 2b
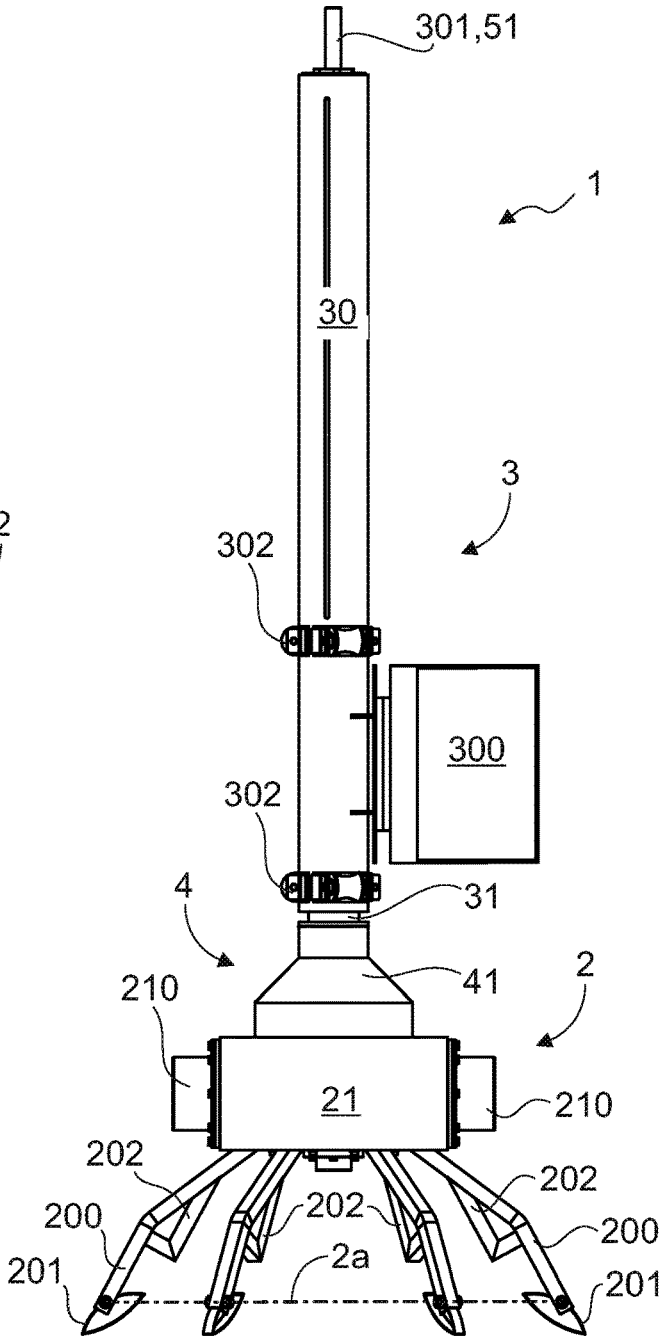

IN-PORT SHIP EXHAUST CAPTURE DEVICE

CROSS-REFERENCE TO RELATED APPLICATIONS

This application is a continuation of U.S. application Ser. No. 17/362,141, filed on Jun. 29, 2021, the disclosure of which is incorporated herein by reference.

This invention is a device for capturing ship exhaust in ports of the type specified in the preamble of the first claim. Specifically, this invention is a terminal for an exhaust capture device, i.e., a collection hood and a handling unit for maneuvering the hood.

As we know, when a ship comes to port, it can moor itself under its own engine power. Alternatively, the mooring of a ship is carried out by a special tow that connects to the ship entering port and leads the ship to the mooring area.

The techniques described above have some significant drawbacks. The first major drawback is the fact that the ship's engines produce large quantities of exhaust fumes that significantly worsen the air quality, not only within a port but also in the surrounding areas. It should be noted that this inconvenience is particularly evident because while in port, to ensure the operation of its instruments and the various utilities in use by the people on board, the ship lowers the main navigation engine to stand-by, but engages the auxiliary generator(s) and keeps the on-board boiler running (if there is one) to ensure on-board services, including safety and security services, and to ensure the operation of drainage systems, loading/unloading equipment and other vital ship functions for the entire time it is moored at the port. As a demonstration of this problem, it has been reported that in the port of Naples alone, from Oct. 17, 2014 to Dec. 31, 2014, the ships released an estimated total of about 840 tons of pollutants into the air.

In an effort to fix this problem, some ports in Northern Europe and the USA have been equipping their mooring docks with electrical power stations, which are connected to the ship while it is moored to provide electrical power for on-board utilities and tools in place of the engines, which, in this case, can be reduced to stand-by while the ship is in port.

Although it reflects an improvement, this solution presents other inconveniences. One drawback is the fact that in order for a port to power all ships, it must install a sizeable power station somewhere near the port, adapt the distribution grid to handle large amounts of energy in addition to the amounts already passing through the grid, and add on an entire series of electrical infrastructure elements, such as transformers, cable ducts, and frequency change stations (many ships are powered at 60 Hz, while others are powered at 50 Hz) at every docking station in the port, all of which requires enormous investments, lengthy construction times and considerable inconvenience for all port bodies due to the simultaneous presence of numerous worksites, excavation works, civil and masonry works, renovations and construction.

Another major inconvenience is the fact that ships, especially older ones (approximately 90% of the ships in use), lack the hardware for connecting to such an installation and, consequently, cannot be powered from the outside. To adapt the ships to this solution, ship owners would be forced to invest in expensive retrofitting works for their ships.

Special treatment systems have been created, however, to reduce the release of exhaust gases into the atmosphere, such as the one described in patent application EP-A-3112011. This system basically consists of a ship exhaust collection hood that is designed to be attached directly to the exhaust outlet of the ship's funnel in order to collect the exhaust gases as they come out of the funnel, a scrubber for the exhaust gases collected by the collection hood in order to reduce the pollutants in the exhaust gases, and a handling unit designed to move the collection hood into position on the exhaust outlet.

These systems also entail some significant drawbacks. Specifically, the handling units for these types of systems are bulky and are built ad hoc for use with the collection hoods. Due to the shape of the collection hoods, furthermore, they must be positioned very precisely on the ship's funnel, because even a minor miscalculation can mean the hood does not fit correctly, with subsequent losses in efficiency in terms of exhaust gas collection. The complexity of the systems and the precision that is required entail high production costs, as well. Indeed, at present, these current systems include handling units that, when the collection hood is in use, are forced to wait until the exhaust gas suctioning is complete. This makes the cost of this known technique very high in terms of time and use. In addition, another inconvenience of known systems is the fact that while the exhaust gases are being captured and treated, the handling unit suffers wear and tear caused by the rocking/oscillation of the ship and the funnel.

Given this situation, this invention's technical task is to design a device that can substantially overcome at least some of these issues while capturing in-port ship exhaust. As part of this technical task, it is important for the invention to offer an in-port ship exhaust capture device that is not affected by the ship's rocking and oscillations while in port.

Another important purpose of the invention is to create an in-port ship exhaust capture device that prevents the handling unit from being subjected to stress while the exhaust gases are being captured.

Another related purpose is to make it unnecessary for the handling unit to remain engaged while the suction system is in operation.

Yet another task of the invention is to avoid the creation of handling units that must also simultaneously guarantee the suction or capture function, thus simplifying the structure and reducing the cost of the device.

In conclusion, a further purpose of the invention is to create a device that is easy to center and line up with the funnel.

The technical tasks and the specified purposes are achieved by the in-port ship exhaust capture device as claimed in the attached claim 1. Preferred technical solutions are shown in the dependent claims.

BRIEF DESCRIPTION OF THE DRAWINGS

The characteristics and advantages of this invention are explained below in the detailed description of the preferred implementations of the invention, in combination with the drawings, in which:

FIG. 2*a* shows a front view of an in-port ship exhaust capture device based on the invention with the collection mouth in the configuration for use, i.e., closed;

FIG. 2*b* is a front view of an in-port ship exhaust capture device based on the invention with the collection mouth in the configuration for handling or rest, i.e., open;

DETAILED DESCRIPTION

Figure 1:
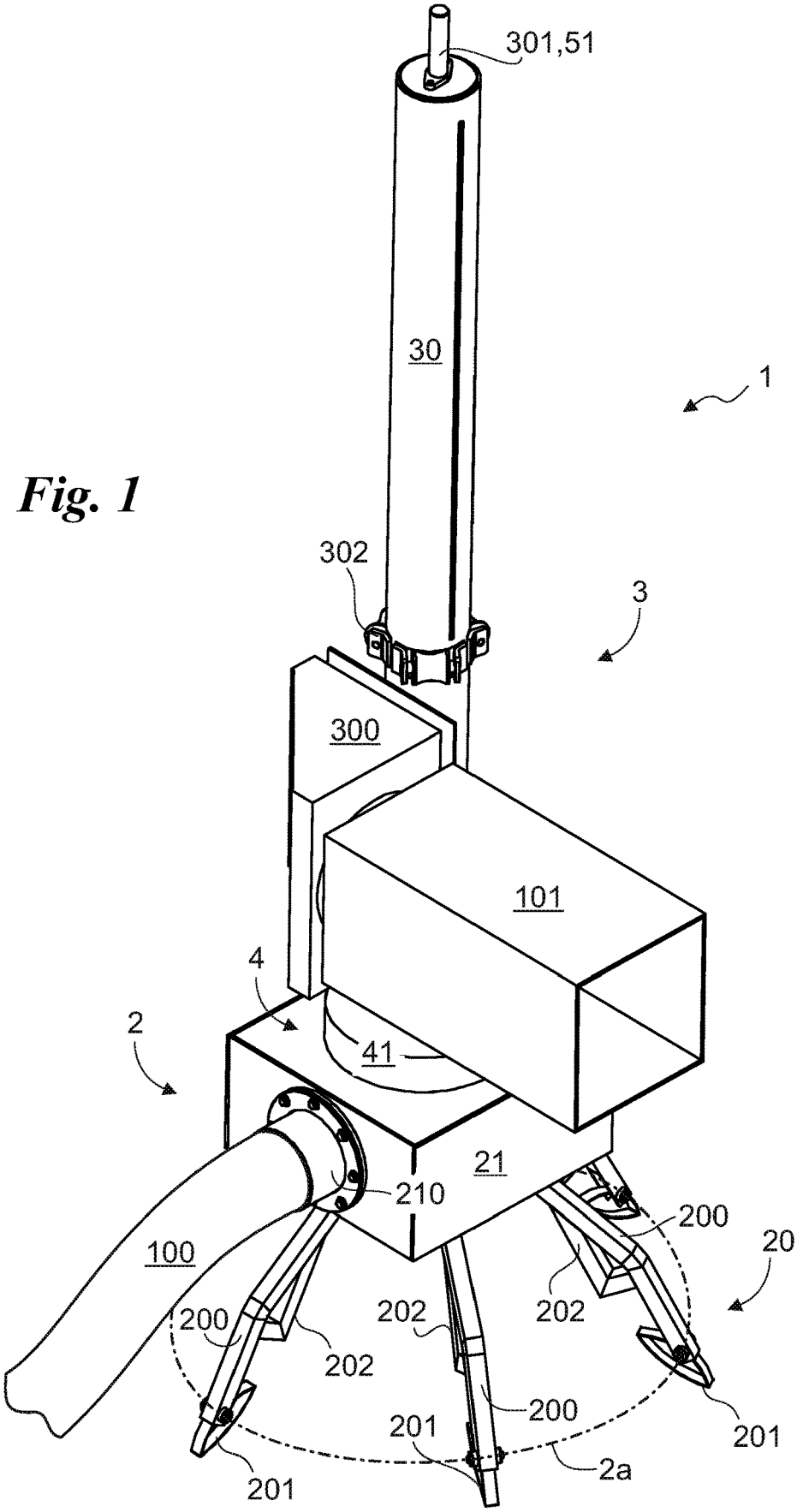
FIG. 1 shows a perspective view of an in-port ship exhaust capture device based on the invention.
Figure 3:
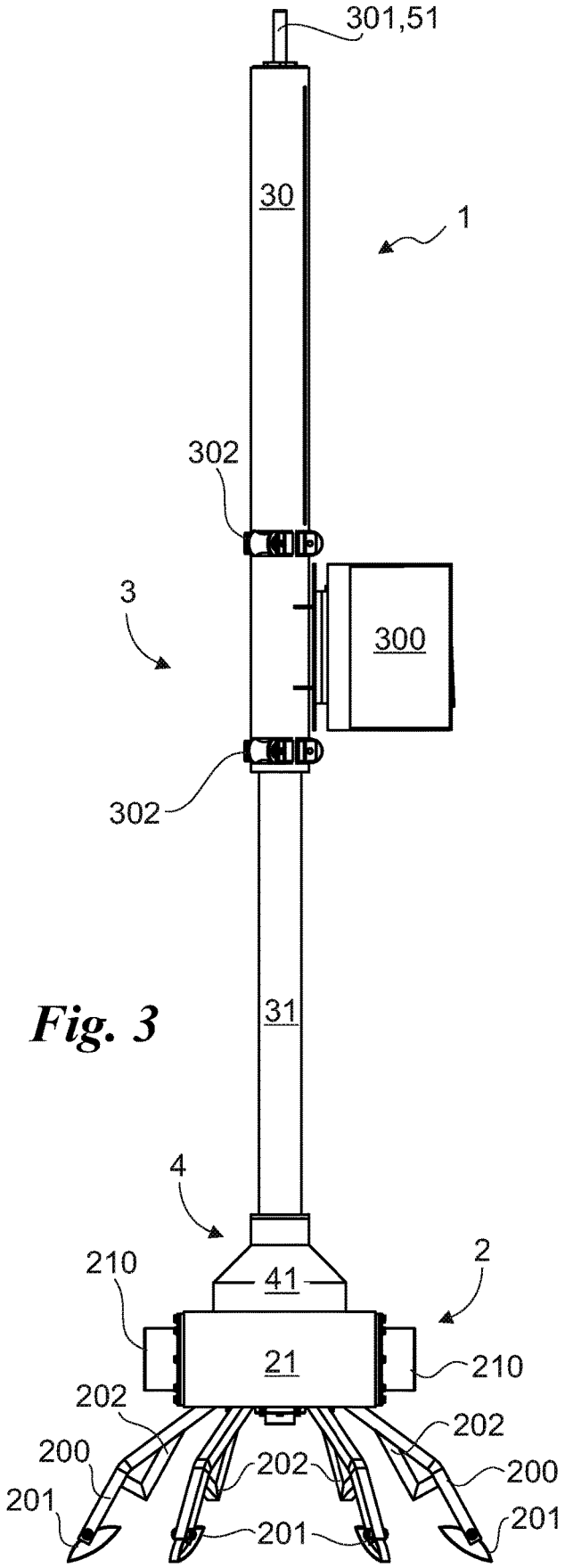
FIG. 3 represents a front view of an in-port ship exhaust capture device based on the invention with the accompanying element extracted.
Figure 4:
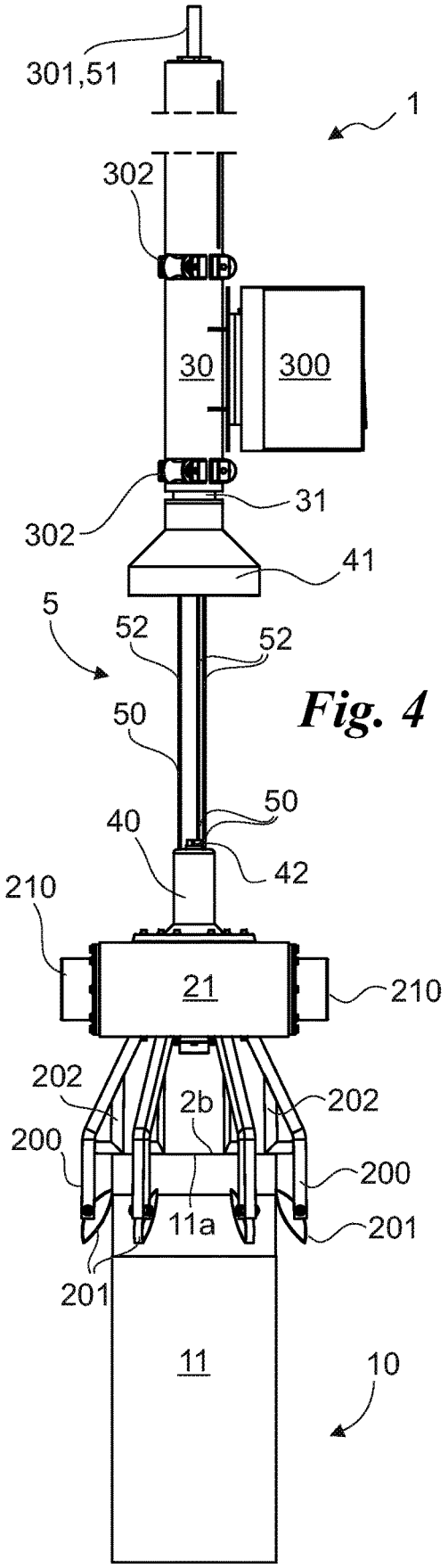
FIG. 4 shows a front view of an in-port ship exhaust capture device based on the invention with the accompanying element retracted, the first constraint terminated or released and a close-up of the second constraint in view.
Figure 5:
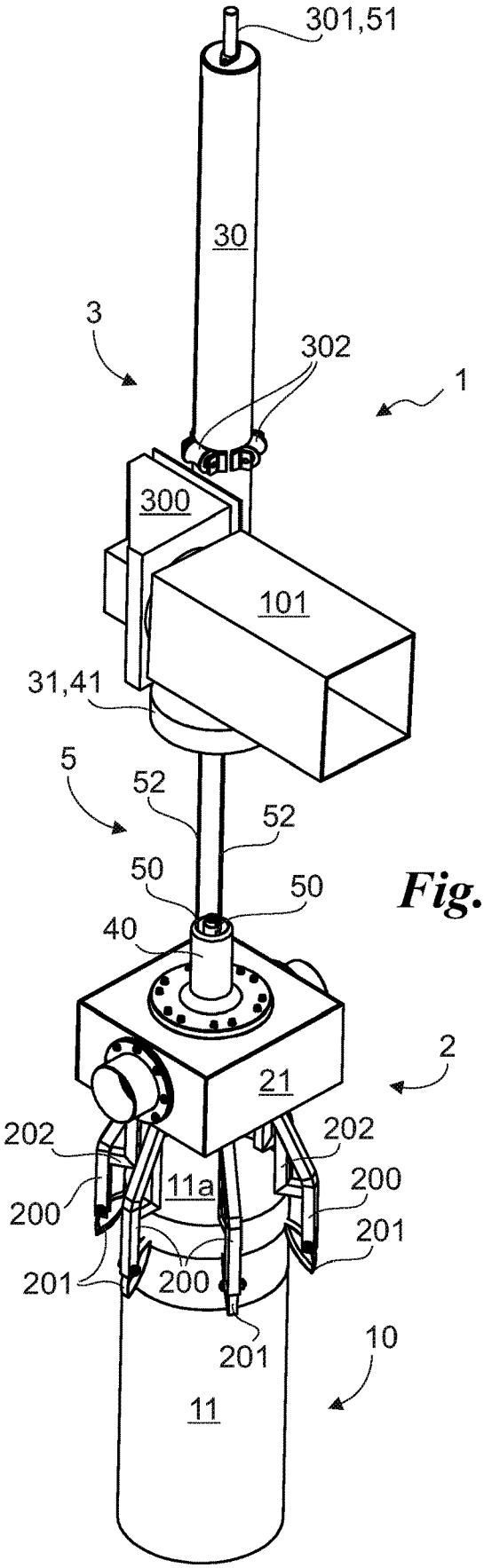
FIG. 5 shows a perspective view of an in-port ship exhaust capture device based on the invention with the accompanying element retracted, the first constraint terminated or released and a close-up of the second constraint in view.
Figure 6A:
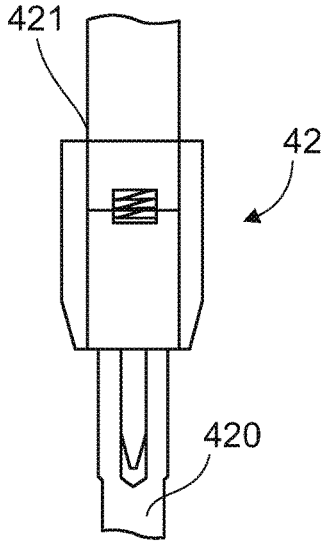
FIG. 6*a* is a close-up of the constraint body of an in-port ship exhaust capture device based on the invention in which the transmission bar and slider are interconnected.
Figure 6B:
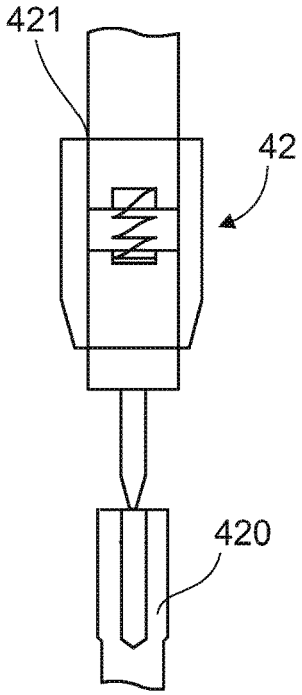
FIG. 6*b* represents a close-up of the constraint body of an in-port ship exhaust capture device based on the invention in which the transmission bar and slider are disconnected.

The measurements, values, shapes and geometric references (such as perpendicularity and parallelism) in this document, when coupled with words such as "approximately" or similar terms, such as "nearly" or "substantially", are to be understood as acknowledging measurement errors or inaccuracies due to production and/or manufacturing errors and, above all, minor variations from the associated value, measurement, shape or geometric reference. When these terms are associated with a value, for instance, they preferably indicate a variation of no more than 10% of the value. When terms such as "first", "second", "superior", "inferior", "main" and "secondary" are used, furthermore, they do not necessarily indicate an order, a relationship of priority or a relative position, but may be used simply to clarify the distinction between different components. Unless otherwise indicated, the measurements and data reported in this text should be considered as performed in the ICAO Standard International Atmosphere (ISO 2533:1975).

In the Figures, the in-port ship exhaust capture device based on the invention is indicated throughout with the number 1. It is intended, more specifically, to capture ship exhaust in order, for example, to allow for subsequent scrubbing of the exhaust gases produced by ship 10 by reducing them and, preferably, nearly eliminating their environmental impact. Device 1, in other words, could form part of a port system that is designed, as a whole, to abate and thus at least reduce the concentration of the pollutants in the exhaust gases of ship 10.

Ship 10 has at least one funnel 11 in which the exhaust gases produced by ship 10 converge and includes exhaust opening 11*a* for the exhaust gases from funnel 11. Exhaust gases include substances combusted by a combustion process, such as the substances produced by a propulsion engine and/or an electric power generator powered by fossil fuels, such as HFO (Heavy Fuel Oil), IFO (Intermediate Fuel Oil) or MGO (Maritime Gas Oil), or other fuels suitable for running a diesel engine or generator and an on-board boiler, when there is one.

In-port ship exhaust capture device 1 includes, in general terms, at least one collection device 2 and at least one handling unit 3. Collection device 2 is preferably suitable for collecting or, to be more precise, suctioning exhaust gases from funnel 11. Preferably, therefore, it includes a hood 20. Hood 20 is the portion of collection device 2 that is designed to be attached to funnel 11 at exhaust outlet 11*a*, so as to collect the exhaust gases coming out of funnel 11. Hood 20, therefore, preferably has a longitudinal axis along which it is possible to distinguish an exhaust gas collection chamber; a gas inlet opening into the chamber; and, appropriately, an exhaust gas outlet opening from the collection chamber. Hood 20 and the chamber, therefore, are preferably tapered along the longitudinal axis with a maximum cross-section that matches the inlet opening. More appropriately, the hood and the chamber are conical or arched.

Hood 20, therefore, includes arms 200 and a casing. The casing, which is not shown in the figures, is preferably a cover positioned around arms 200 so as to form the chamber. The casing, therefore, preferably consists of a material that is impermeable to exhaust gases and capable of isolating the chamber from the outside environment. More specifically, the casing may be made of fabric or polymer membranes. Arms 200 basically serve as a support skeleton for the casing. They are similar to the fingers of a hand, which can be closed or opened. When closed, preferably, the arms approach the longitudinal axis.

Arms 200 are preferably configured to form collection mouth 2*a*. Collection mouth 2*a* is preferably the access area to the chamber of hood 20. Collection mouth 2*a*, therefore, basically coincides with the inlet opening of the chamber, preferably. Furthermore, preferably, collection mouth 2*a* has a substantially circumferential shape and is dilatable. This dilation is achieved, by means of controls, through the movements of arms 200. Specifically, collection mouth 2*a* is designed to contract or dilate in order to constrain or release hood 20 from funnel 11. Arms 200, therefore, may preferably be rigid rods capable of rotating around a predetermined axis. In particular, preferably, arms 200 are all attached at the same level and arranged around a circumferential profile. They are also equidistant from one another. By rotating each arm along an axis tangential to the circumferential profile, therefore, they are able to dilate or contract collection mouth 2*a*.

Preferably, collection device 2 also includes connection portion 21, described below, which defines the plane along which arms 200 are attached but moveable. Preferably, arms 200 are attached to connection portion 21 corresponding to the outlet opening of hood 20. The outlet opening of the chamber, therefore, is preferably designed to transfer the exhaust gases to connection portion 21.

Preferably, arms 200 are arranged along the described circumferential profile, which is preferably centered on the longitudinal axis. Advantageously, arms 200 include special sealing elements 201. Sealing elements 201 are preferably arranged at the free end of each arm 200. In addition, each sealing element 201 can oscillate freely or tilt around an axis tangential to collection mouth 2*a*. Essentially, therefore, given the conformation of hood 20 in the preferred shape, as described, collection mouth 2*a* also defines a circumferential trajectory centered around the longitudinal axis, and sealing elements 201 can rotate around the axes tangential to the circumferential trajectory.

In even greater detail, sealing elements 201 are preferably capable of tilting so that they are always oriented, essentially, towards the longitudinal axis, i.e., towards the inside of the chamber defined by hood 20. Sealing elements 201, therefore, are the first elements capable of interacting directly with funnel 11. They are designed to lean against funnel 11 around exhaust outlet 11*a* so as to automatically bring hood 20 into alignment with funnel 11.

In addition, arms 200 include another measure. In particular, preferably, most of the arms 200 include a support template 202. Each arm 200 could include a support template 202, of course, but it is not necessary for every arm 200 to have one. Support template 202 is preferably arranged adjacent to connection portion 21, i.e., approximately at the outlet opening of the chamber. In addition, preferably, each template 202 faces the inside of the chamber, i.e., towards the longitudinal axis. In particular, support templates 202 function together to create support surface 2*b*. Support surface 2*b* is preferably suitable for allowing collection mechanism 2 to rest against funnel 11 at exhaust outlet 11*a*. In essence, more specifically, support templates 202 create a support portion for hood 20, where the interaction between funnel 11 and hood 20 consists of the parts of templates 202 that make up support surface 2*b*.

Connection portion 21 is preferably, as already mentioned, the portion designed to receive exhaust gases from hood 20. Preferably, connection portion 21, therefore, is basically arranged at the outlet opening of hood 20 and holds part of hood 20 in that area, as already described. In addition, connection portion 21 has a fluid passageway connection with hood 20. In order to make this connection, the connection portion has a casing with one or more passage holes 211. Passage holes 211 are preferably connected directly to the outlet from the chamber of hood 20 so as to allow for the transit of the exhaust gas inside it.

In addition, connection portion 21 includes at least one collector 210. Collector 210 is preferably suitable for allowing the exhaust gases to be expelled from connection portion 21. Collector 210, therefore, may take the form of an outlet hole connected to one or more passageway holes 211. In this way, preferably, exhaust gases may be collected from collection mouth 2*a*, introduced into the chamber of hood 20, forwarded to connection portion 21 through passageway hole(s) 211 and expelled from collector 210.

As already mentioned, of course, connection portion 21 may include a conduit or a watertight tank designed to connect passageway hole 211 and/or the outlet opening of hood 20 to collector 210. Collector 210, therefore, is preferably designed to allow for a connection between connection portion 21 and suction device 100. Suction device 100 is designed to suction and capture the exhaust gases, for example, and convey them to external equipment for treatment. Preferably, device 1 does not include suction device 100 as well. Alternatively, device 1 may include at least part of suction device 100. In any event, regardless of whether device 1 includes suction device 100, it is preferably intended, while in use, to convey the exhaust gases of ships 10 through suction device 100, which is preferably connected to collectors 210. Suction device 100 is preferably external, in fact, and capable of collecting the exhaust gases and conveying them far away from collection device 2.

Suction device 100 can then be connected to external devices, such as external scrubbers. These scrubbers may be used to eliminate the pollutants found in the exhaust gases. In particular, the scrubbers are, for example, capable of intercepting and thus retaining particulate matter of the appropriate diameter of at least 10 μm, to be precise, 1 μm or, even more precisely, 0.1 μm. They may include at least one filtering body designed to retain particulate matter, and thus pollutants; and a vacuum generating device, preferably downstream from the filtering body, designed to depressurize the chamber of hood 20, at least, so as to draw the gases from the chamber and control their passage through connection portion 21 to the filtering body.

The term 'filtering', as used here, refers to any treatment of polluting substances, including any transformation into non-harmful substances. The filtering body may include sulfur filters designed to capture sulfur oxides or nitrogen filters for capturing nitrogen oxides. Preferably, the body includes sulfur and nitrogen filters arranged in series so as to allow the gases to pass through both filters. Sulfur filters consist of one or more sleeve filters, preferably ceramic, that the exhaust gases can pass through internally. Sulfur filters include one or more sorbent filters. Nitrogen filters include one or more urea filters.

The vacuum generation device preferably includes a fan and a motor for controlling the fan. In particular, a single scrubber may be placed on the ground or, more specifically, on a transport vessel designed to be positioned near ship 10, on the free side opposite the mooring dock. In this case, the scrubber includes a conduit to connect the fluid passage from collection mechanism 2 to the vacuum-generation device, and thus the filters. Preferably, the conduit serves as suction device 100. Specifically, it is flexible so that it can easily be moved towards collector 210 or integrated with collector 210 if part of suction device 100 moves with collection device 2 during the operations for connecting collection device 2 to funnel 11. Preferably, when hood 20 moves, the conduit of suction device 100 is connected to collector 210 and moves, at least in part, together with connection portion 21, and thus with hood 20.

In addition, the scrubber may also include an input collector appropriately placed upstream of the body and, therefore, designed to receive the exhaust gases from collector 210, via suction device 100, and to convey them to the filtering body; and a system for external evacuation of the exhaust gases discharged from the filtering body, or to be appropriately positioned downstream of the vacuum-generation device. In any event, suction device 100 is not part of device 1, but is designed to operate together with it. Device 1 may also be combined with suction device 100 as part of a single system, of course.

Handling unit 3 is preferably suitable for handling collection device 2. Specifically, it is designed to align collection device 2 with exhaust outlet 11*a*. Handling unit 3, however, is preferably designed for moving collection device 2 over short distances, as further detailed below.

In fact, collection device 2 is designed for long-distance moving by means of external support 101. In this respect, and as further detailed below, device 1 is basically an exhaust gas treatment plant terminal. Handling unit 3, in particular, is preferably intended to move together with external support 101 and is directly connected to it. In general, external support 101 is designed, through handling unit 3, to pick up collection device 2 from a loading station conveniently located on land or, if necessary, on a transport vessel, which may also include treatment devices, such as scrubbers, and part of suction device 100.

External support 101 may consist, preferably, of a crane that can be attached to handling unit 3 of device 1 and includes a hoisting structure designed to control the motion of handling unit 3 and, therefore, collection device 2 as well, if collection device 2 and handling unit 3 are mutually interconnected. In some cases, external support 101 may also include a rotary platform capable of supporting and rotating handling unit 3 over long distances, around what is basically a vertical axis.

The hoisting structure may be an articulated arm designed to support handling unit 3 and include a series of profiles that can move freely and reciprocally, adapting the extension of the hoisting structure and, therefore, moving at least part of device 1. In particular, the articulated arm may include a first profile for supporting handling unit 3; one or more freely adjustable second profiles that are, more specifically, hinged with the adjacent second profiles and/or the first profile; and at least one handling section for controlling the reciprocal rotation between adjacent profiles and, therefore, variations in the extension of the articulated arm. In order to simplify the handling, moreover, the conduit for suction device 100 may be attached to the second profiles, at least, so that it can follow the articulated arm and connection portion 21 during their movements. External support 101, in the same way as suction device 100, is not part of device 1. Device 1, suction device 100 and external support 101, however, preferably constitute a complete exhaust gas treatment plant for ships in port.

As already mentioned, suction device 100 may be at least partially attached to, and guided by, external support 101, or may be completely independent of it. Handling unit 3, therefore, is preferably designed for handling collection device 2 in relation, preferably, to external support 101. In this regard, handling unit 3 includes support structure 30 and accompanying element 31. Support structure 30 is preferably the support structure for the entire handling unit 3. Therefore, preferably, support structure 30 is the part of handling unit 3 that is directly connected to external support 101. Preferably, support structure 30 is not only designed to attach device 1 and external support 101 to each other, but may also be designed to allow reciprocal movement between them, at least for small movements.

Preferably, support structure 30 at least includes, in fact, command device 300. Command device 300 is preferably designed to allow reciprocal movement between handling unit 3 and external support 101. Specifically, it can at least allow for their reciprocal rotation around at least one axis. Preferably, the at least one axis is parallel to the ground. Preferably, command device 300 enables the rotation of device 1, and handling unit 3, in particular, around two axes orthogonal to the longitudinal axis, i.e., the axis which is basically perpendicular to the ground. In detail, furthermore, the two axes are also orthogonal to one another.

Figure 8A:
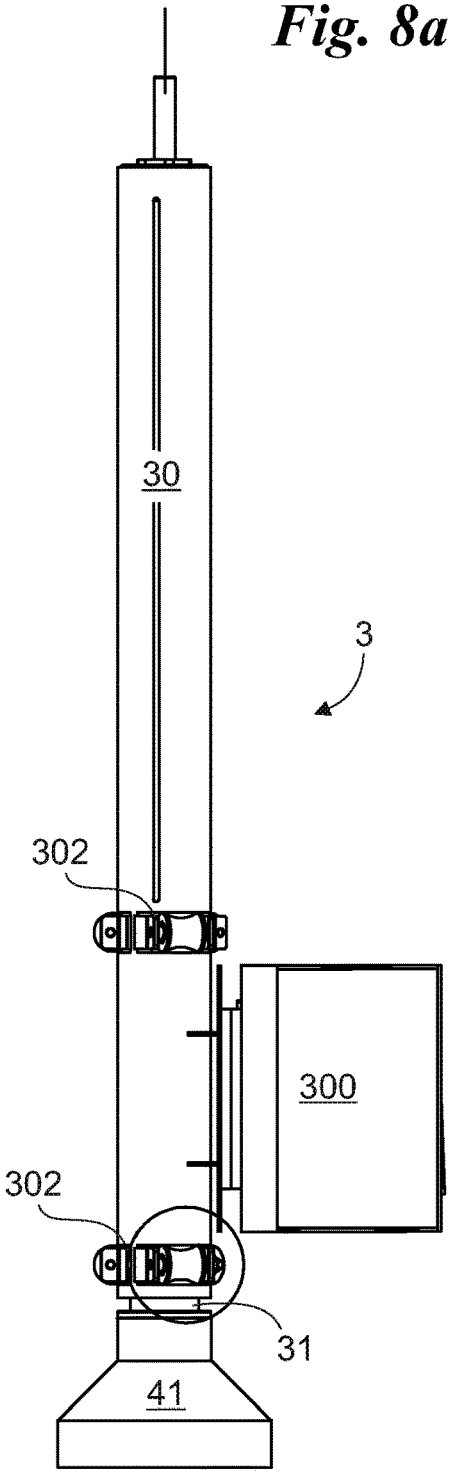
FIG. 8*a* represents a front view of the handling unit for an in-port ship exhaust capture device based on the invention.
Figure 8B:
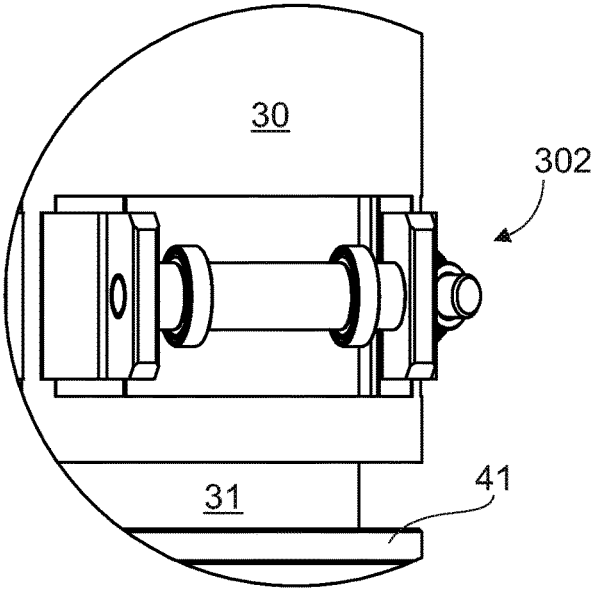
FIG. 8*b* shows a close-up of the handling unit depicted in FIG. 8*a*, highlighting the handling guides for the accompanying element.

Accompanying element 31 is preferably extendable and retractable relative to support structure 30, by command Preferably, and specifically, it is extendable and retractable along the longitudinal axis. Support structure 30 and accompanying element 31, therefore, basically form a piston configuration in which support structure 30 acts as the guide within which the cylinder represented by accompanying element 31 is moved. Preferably, therefore, support structure 30 includes at least one guide 302. Even more specifically, support structure 30 includes at least two guides 302 designed to control the reciprocal movement between support structure 30 and accompanying element 31. For example, guide 302 may include a flange around support structure 30, as shown in FIG. 8*b*, that connects to the inside of support structure 30 so as to affect accompanying element 31 and includes one or more guide rollers. This type of mechanism allows for the controlled movement of accompanying element 31, although this is only one of many possible mechanisms. Specifically, accompanying element 31 is the primary portion of the handling unit intended to move collection device 2 directly.

Preferably, handling unit 3 and collection device 2 are mutually connected by a first constraint 4. Advantageously, the first constraint 4 is preferably configured to interconnect or disconnect collection device 2 and handling unit 3 on command. In regard to the 'commands' for the handling unit, the first constraint 4 and the subsequent commandable devices, of course, it is understood that device 1 as a whole is designed to be connected to electronic processors and command panels that allow the user to use all the functions described for device 1. Specifically, the first constraint 4 allows for at least two distinct configurations: a handling configuration and a collection configuration. In the handling configuration, preferably, collection device 2 and handling unit 3 are interconnected by the first constraint 4 and move together as one. In the collection configuration, instead, preferably, collection device 2 collects the exhaust gases and is released from the handling unit 3 by disconnecting the first constraint.

In order to realize these configurations, in greater detail, the first constraint 4 consists of transmission device 40 and attachment device 41. Transmission device 40 is preferably attached to and integrated with collection device 2. In even greater detail, it is placed at the top, relative to the ground, of connection portion 21. Attachment device 41 is, on the other hand, attached to and integrated with handling unit 3. Specifically, attachment device 41 is attached to accompanying element 31 and is actually a part of it. In essence, attachment device 41 is positioned at the free end of accompanying element 31. Transmission device 40 and attachment device 41 are, moreover, preferably, at least partially counter-shaped to allow for reciprocal interlocking, at least along the plane perpendicular to the longitudinal axis.

Figure 7A:
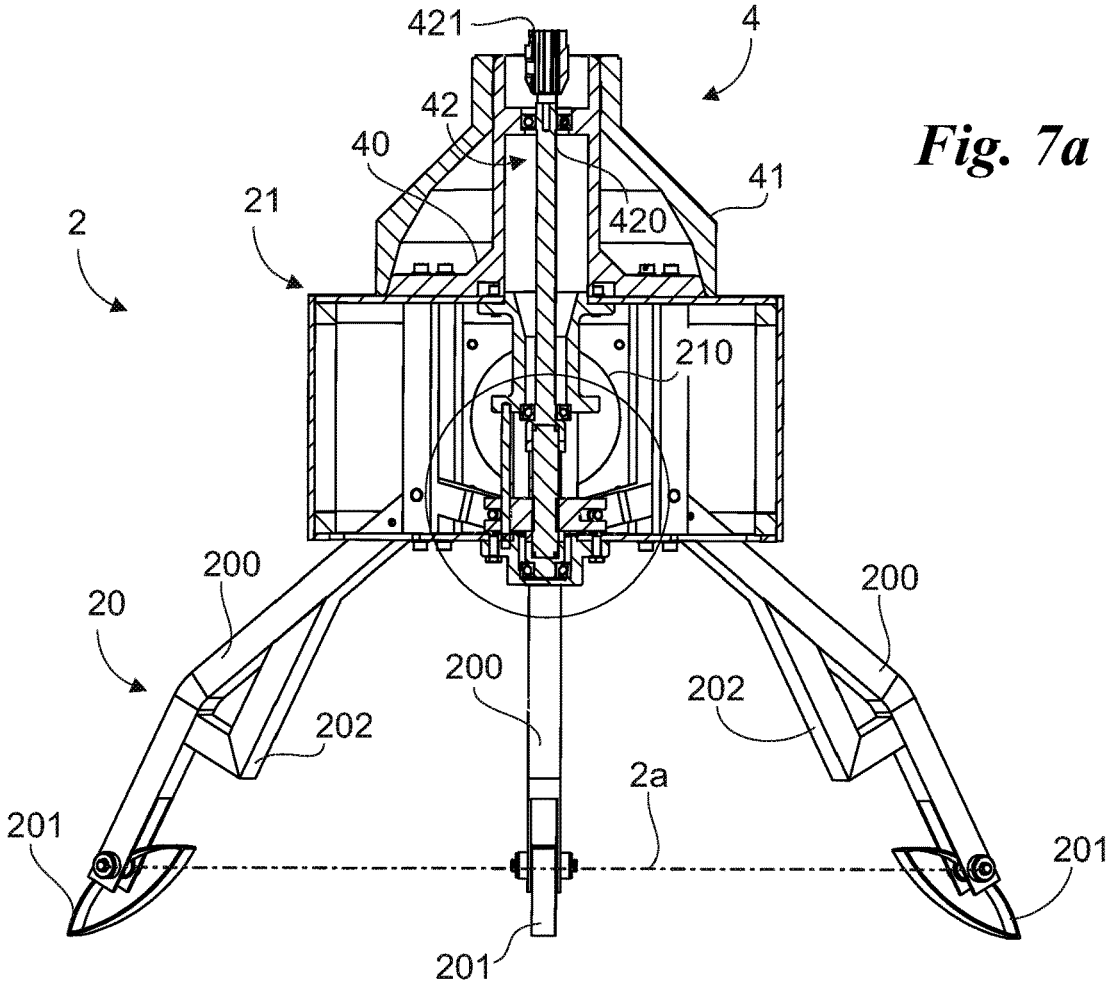
FIG. 7*a* shows a longitudinal cross-section of the collection mechanism of an in-port ship exhaust capture device based on the invention.
Figure 7B:
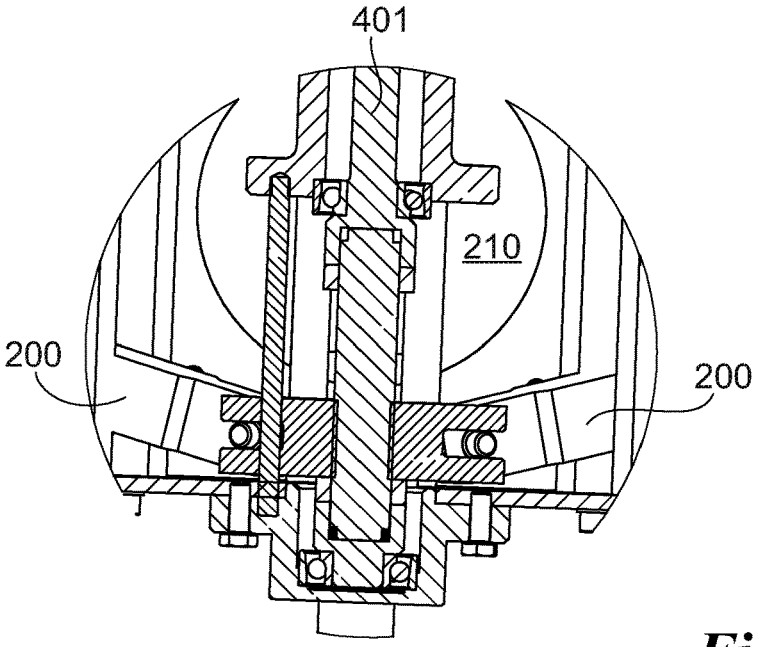
FIG. 7*b* shows a detail of the mechanism depicted in FIG. 7*a;*
Figure 7C:
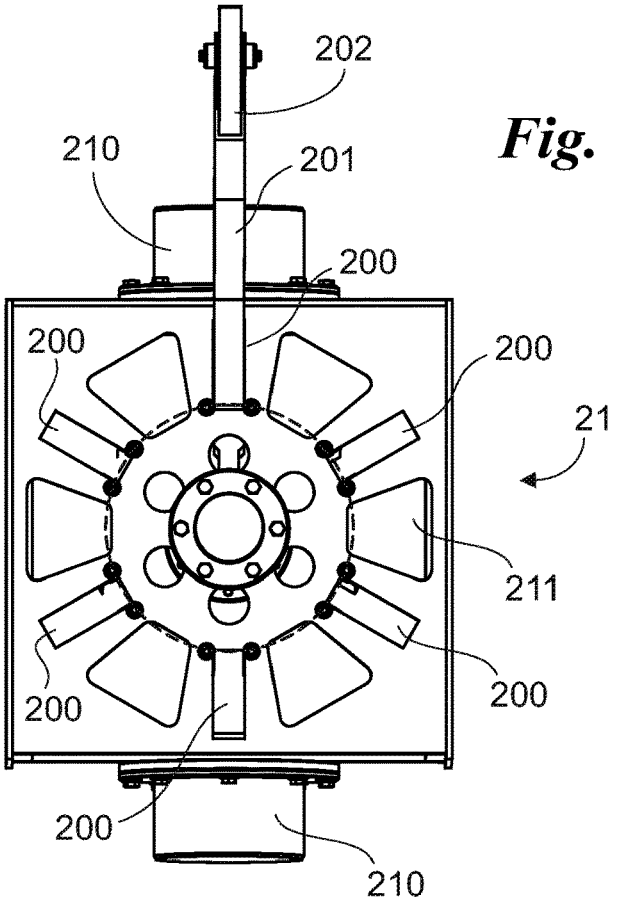
FIG. 7*c* is a bottom view, i.e., from the funnel, of the mechanism shown in FIG. 7*a;*

Specifically, attachment device 41 has an advantageous cup shape. In greater detail, attachment device 41 has a divergent form starting from handling unit 3 so as to facilitate the coupling with transmission device 40. Preferably, as clearly shown in FIG. 7*a*, attachment device 41 has a first portion adjacent to accompanying element 31 that is counter-shaped to fit with transmission device 40. Attachment device 41 also has a second portion located some distance from accompanying device 31 and designed to adhere, when handling unit 3 and collection device 2 are attached, separately from the connection portion 21. The second portion then defines the cup or mouth or the cone that accommodates transmission device 40.

Specifically, attachment device 41 includes walls, corresponding to the second portion, that serve for guiding the attachment device 41 onto transmission element 40 so that they can be centered independently. During the coupling phase, in other words, the attachment device 41, thanks to the cup, slides along transmission element 40 and is independently centered on it.

The first constraint 4, furthermore, also includes constraint body 42. Constraint body 42 is preferably configured to operationally connect—rigidly, for instance—to transmission device 40 and attachment device 41, by command Preferably, constraint body 42 is basically intended to operationally connect handling unit 3 to collection device 2 so that motion can be transmitted between them. In this specific respect, constraint body 42 includes transmission bar 420 and slider 421. Transmission bar 420 is preferably included with collection device 2, while slider 421 is included inside handling unit 3. Preferably, transmission bar 420 includes a partial bore extending longitudinally, i.e., parallel to the longitudinal axis, and is flexibly attached to transmission device 40 so that it can be moved in relation to it.

Preferably, slider 421 can be inserted into transmission bar 420 on command. It is flexibly attached, therefore, to attachment device 41 in such a way as to transmit the motion from handling unit 3 to collection device 2. Slider 421 is preferably a click element, for example, capable of being moved against a spring so that it is guided towards transmission bar 420 when transmission device 40 and connection device 41 come close to one another.

From an operational point of view, transmission bar 421 is designed to move at least part of collection device 2 so as to allow for the opening or closing of hood 20 around funnel 11. Essentially, transmission bar 421 is the instrument by which handling unit 3 transmits motion to collection device 2 in order to control hood 20. Device 1, therefore, may only include the first constraint 4 that can be released. Or it could also include a second constraint 5.

Advantageously, device 1 includes, preferably but not necessarily, the second constraint 5 as well. The second constraint 5 is preferably configured to connect collection device 2 and handling unit 3 together in such a way that collection device 2 and handling unit 3 are at least partially independent. Essentially, therefore, the second constraint 5 preferably consists of constraints that are redundant in relation to the first constraint 4. They do not, however, rigidly connect collection device 2 to handling unit 3. The second constraint 5, in the preferred configuration, is preferably configured to interconnect collection device 2 and handling unit 3 when they are brought closer together, while collection device 2 and handling unit 3 are configured to make them completely and flexibly independent when they are separated from each other.

The second constraint 5 preferably includes at least one first element integrally attached to attachment device 41 and a second element integrally attached to transmission device 40. The first and second elements are preferably configured to exert a reciprocal magnetic attraction force on command. In general, therefore, second constraint 5, in this configuration, is configured to exert a magnetic attraction force, on command, to bring first constraint 4 into handling configuration. To achieve this configuration, both elements may be magnetically reactive, with opposite polarity, but it is also sufficient for only one element to be magnetized while the other is ferromagnetic and designed to react with the other element and obtain a mutual force of attraction. In order to improve the command function, preferably, second constraint 5 is at least partially electromagnetic. Preferably, therefore, at least one of the elements is electromagnetic and designed to generate a magnetic field that attracts the other element. The first element is the electromagnetic element, preferably, and the second element is designed to react to the magnetic field generated by the first element, on command.

In detail, the first element is preferably positioned to correspond with the first portion of attachment device 41, while the second element is positioned to correspond with the portion of transmission device 40 which is designed for coupling with attachment device 41. In other words, the second constraint 5 is positioned in the counter-templated attachment device 41 and transmission device 40 zone. Therefore, the cup of attachment device 41 and the second constraint 5 can provide a synergistic centering device that centers the first constraint 4 automatically.

In an alternative or additional configuration, the second constraint 5 preferably allows for collection device 2 to hang from handling unit 3, so that it is basically suspended from it. In this configuration, the second constraint 5 preferably includes a first end 50 and a second end 51. Preferably, the two ends, 50 and 51, are spaced relative to one another along the longitudinal axis. In addition, specifically, the first end 50 is attached to and integrated with collection device 2, while the second end 51 is preferably attached to and integrated with handling unit 3. The two ends, 50 and 51, therefore, are interconnected by means of connection body 52. The latter is configured to connect the two ends, 50 and 51, and is preferably flexible. Specifically, furthermore, it is essentially a long body which extends primarily along the longitudinal axis.

An example of connection body 52 might consist of a wire or cable made of steel, for instance, which is capable of maintaining the connection between collection device 2 and handling unit 3 while ensuring a high degree of flexibility between the parts. The second constraint 5 may also statically connect collection device 2 and handling unit 3 along the longitudinal axis, or may flexibly connect, on command, collection device 2 and handling unit 3 along the longitudinal axis. For example, they can make it possible to pull collection device 2 towards or release it away from handling unit 3.

In this regard, preferably, support structure 30 may include control means 301. Control means 301 is preferably attached to the second end 51 of second constraint 5 or, more specifically, the latter is connected to it in such a way as to allow the movement of at least part of the second constraint 5. For example, control means 301 may include a winding roll or winch capable of reeling in part of connection body 52. In general, however, control means 301 may be of any nature compatible with the second constraint 5. Control means 301 is primarily configured to retract or release connection body 52 in such a way as to bring collection device 2 and handling unit 3 closer together or further apart.

The commands for control means 301, of course, as well as the other components of device 1 and the overall system itself, can be delegated to pre-existing electronic systems in the technology sector. Specifically, the approaching or distancing takes place when the connection realized by the first constraint 4 is released.

The operation of the in-port ship exhaust capture device 1, as described in structural terms above, is basically the same as the already existing devices at the present state of technology. This invention, however, incorporates a new process for capturing in-port ship exhaust. Preferably, and specifically, the procedure includes a phase in which device 1 is positioned near funnel 11 by using the systems and means described above, such as external support 101.

Furthermore, the procedure advantageously includes a handling phase in which handling unit 3 places hood 20 in position around funnel 11 in preparation for the subsequent coupling phase. In the coupling phase, hood 20 is latched on to the funnel by closing the arms 200 towards the longitudinal axis. The transmission of the arms' motion is ensured by constraint body 42, specifically.

Once collection device 2 has been attached to funnel 11, the process calls for a release phase. During the release phase, the first constraint 4 is released and handling unit 3 is pulled away from collection device 2. Preferably, handling unit 3 is not moved away as a whole, and only accompanying element 31 is withdrawn by retracting it into support structure 30. If present, the second constraint 5 continues to keep handling unit 3 and collection device 2 connected while still allowing for reciprocal movement between them.

The process may then include a suction phase, in which the external suction device 100 suctions the exhaust gases passing through collector 210. When the capture is finished, in the coupling phase, handling unit 3 and collection device 2 may be brought closer once again in such a way as to re-shape the first constraint 4. The coupling may take place, in a manner commanded by an operator, by bringing accompanying element 31 close to connection portion 21 independently. Alternatively, the coupling may be assisted by the second constraint 5, for example, which could reel in connection body 52 by means of control device 301.

The in-port ship exhaust capture device 1 represented by this invention offers important advantages. Device 1, in fact, makes it possible to create a terminal for a ship exhaust capture system that is not affected by the rocking and oscillations that a ship experiences in port. Following the attachment phase, in fact, handling unit 3 can be released from collection device 2 while it is suctioning the exhaust gases. Handling unit 3, therefore, undergoes less stress during the exhaust suction phases.

If the second constraint 5 is present, furthermore, device 1 makes it possible to increase stability by reducing the weight of collection device 2 on funnel 11 and improves the speed and precision of the coupling phase after the suctioning. In addition, sealing elements 201 on arms 200 make it possible to increase the efficacy of hood 20 while it is being centered on funnel 11, ensuring what is basically automatic centering.

If the second constrain 5 is not present, then device 1 does not need to keep handling unit 3 occupied during the suction phases. Handling unit 3 can thus be used for other activities while collection device 2 is still processing the exhaust gases.

In conclusion, device 1 makes it possible to detach suction device 100 and make it independent from external support 101, which offers obvious advantages in terms of maintenance and structure.

The design of capture device 1, in conclusion, reduces the safety risks for the operator, who can manage all the capture and conveyance phases for subsequent treatment remotely, i.e., from external structure 101, such as a crane firmly anchored to the ground. This means the operator does not need to come dangerously close to the ship with mobile vessels, such as barges or similar vessels.

The invention is susceptible to variants falling within the scope of the inventive concept defined by the claims. In this context, all details may be replaced by equivalent elements and materials, and the shapes and sizes can be of any magnitude.

The invention claimed is:

1. A device for capturing exhaust comprising:

a collection device including a hood configured to attach to an exhaust outlet emitting exhaust;

a handling unit configured to position the collection device on the exhaust outlet;

a first constraint coupling the collection device to the handling unit, wherein the device includes a handling configuration in which the collection device and the handling unit are interconnected by the first constraint and move together, and wherein the device includes a collection configuration in which the collection device after collecting the exhaust is uncoupled from the handling unit, wherein the hood includes arms forming a circumferential and dilatable collection mouth to attach and release the hood to and from the exhaust outlet, and wherein the arms include a sealing element positioned at the free end of each arm.

2. The device of claim 1, further comprising a second constraint configured to exert a force on the first constraint to bring the device into the handling configuration.

3. The device of claim 2, wherein the second constraint includes at least one first element integrally attached to an attachment device and a second element integrally attached to the transmission device.

4. The device of claim 2, wherein the second constraint includes a first end integrated with the collection device and a second end integrated with the handling unit and a flexible connection body to connect the first and second ends thereof.

5. The device of claim 1, wherein the collection device includes a connection portion that provides a fluid passage connection with the hood, and the connection portion includes at least one collector adapted to connect the connection portion to external suction devices adapted to collect the exhaust gases from the collection device and to convey the exhaust gases away from the collection device.

6. The device of claim 1, wherein the first constraint includes a transmission device attached to the collection device, an attachment device attached to the handling unit, and a constraint body connecting, on command while in operation, the transmission device to the attachment device.

7. The device of claim 6, further comprising a constraint body configured to connect the transmission device and the attachment device.

8. The device of claim 7, wherein the transmission device is shaped with respect to the coupling device to allow for reciprocal interlocking and the constraint body includes a transmission bar partially perforated longitudinally and flexibly attached to the transmission device and a slider for insertion in the transmission bar and flexibly attached to the connection device to transmit the motion from the handling unit to the collection device.

9. The device of claim 1, wherein the arms include support templates located adjacent the connection portion that function together to create a support level configured to support the collection device at the exhaust outlet.

10. The device of claim 6, wherein the handling unit includes a support structure and a controllable, removable and retractable accompanying element for the support structure.

11. A device for capturing in-port exhaust from a ship having an exhaust funnel comprising:

a collection device having a longitudinal axis, the collection device including a hood adapted to be attached to an exhaust outlet of the funnel and to collect the exhaust as they are emitted from the funnel;

a handling unit adapted to move the collection device and to position the collection device on the exhaust outlet of the funnel;

a first constraint adapted to connect the collection device to the handling unit and to disconnect the collection device from the handling unit; and a second constraint adapted to connect, on command, the collection device to the handling unit, wherein the device includes a handling configuration in which the collection device and the handling unit are interconnected by the first constraint and move together, and wherein the device includes a collection configuration in which the collection device after collecting the exhaust is uncoupled from the handling unit.

12. The device of claim 11, wherein the collection device includes a connection portion that provides a fluid passage connection with the hood, and the connection portion includes at least one collector adapted to connect the connection portion to external suction devices adapted to collect the exhaust gases from the collection device and to convey the exhaust gases away from the collection device.

13. The device of claim 11, wherein the first constraint includes a transmission device attached to the collection device, an attachment device attached to the handling unit, and a constraint body connecting, on command while in operation, the transmission device to the attachment device.

14. The device of claim 11, wherein the transmission device is at least partially counter-shaped to the attachment device to enable reciprocal interlocking of the transmission device to the attachment device, the constraint body includes a transmission bar attached to the transmission device and a slider attached to the attachment device, the slider being slidable relative to the transmission bar so as to transmit motion from the handling unit to the collection device.

15. The device of claim 11, wherein the second constraint includes at least one first element integrally attached to the attachment device and a second element integrally attached to the transmission device.

16. The device of claim 11, wherein the second constraint includes a first end integrated with the collection device and a second end integrated with the handling unit and a flexible connection body to connect the first and second ends thereof.

17. The device of claim 11, wherein the hood includes arms forming a circumferential and dilatable collection mouth to attach and release the hood to and from the exhaust outlet.

18. The device of claim 17, wherein the arms include a sealing element positioned at the free end of each arm.

* * * * *